US008245605B1

(12) United States Patent
Rygh

(10) Patent No.: US 8,245,605 B1
(45) Date of Patent: Aug. 21, 2012

(54) WRENCH ADAPTER

(75) Inventor: Daniel J. Rygh, Shoreline, WA (US)

(73) Assignee: The Boeing Company, Chicago, IL (US)

( * ) Notice: Subject to any disclaimer, the term of this patent is extended or adjusted under 35 U.S.C. 154(b) by 329 days.

(21) Appl. No.: 12/732,364

(22) Filed: Mar. 26, 2010

(51) Int. Cl.
*B25B 13/58* (2006.01)
*B25B 13/00* (2006.01)

(52) U.S. Cl. ..... 81/184; 81/125

(58) Field of Classification Search ..... 81/184, 81/185.2, 13, 125, 180.1
See application file for complete search history.

(56) References Cited

U.S. PATENT DOCUMENTS 1,352,461 A * 9/1920 Lenholt ..... 81/125.1
1,550,436 A * 8/1925 Hall ..... 81/119
1,635,102 A * 7/1927 Watson ..... 81/63
2,557,628 A * 6/1951 Becker ..... 81/125
2,697,371 A * 12/1954 Bowman ..... 81/125.1
2,880,637 A * 4/1959 Koenig ..... 81/10
4,327,610 A * 5/1982 Chiarenza ..... 81/64
4,336,728 A 6/1982 Deibert
4,406,188 A * 9/1983 Mills ..... 81/180.1
4,631,988 A 12/1986 Colvin
4,718,316 A * 1/1988 Dedrick ..... 81/125
4,787,273 A * 11/1988 Griffith ..... 81/13
5,340,122 A 8/1994 Toboni et al.
5,404,774 A * 4/1995 Bond ..... 81/180.1
5,832,795 A * 11/1998 Reynolds ..... 81/180.1
2007/0056411 A1* 3/2007 Carlson ..... 81/125
2010/0282027 A1* 11/2010 Brovold ..... 81/58.1

* cited by examiner

*Primary Examiner* — David B Thomas
(74) *Attorney, Agent, or Firm* — Armstrong Teasdale LLP

(57) ABSTRACT

A device is provided for use with a wrench including an opening sized to receive a fastener assembly component therein. The device is coupleable to the wrench. The device includes a flange that extends outward from the device and remains spaced a distance from the wrench such that a slot is defined therebetween when the device is coupled to the wrench. The slot is sized and oriented to receive at least one of a washer and a bushing.

20 Claims, 3 Drawing Sheets

WRENCH ADAPTER

BACKGROUND

The field of the invention relates generally to hand tools and more specifically to an adapter for use with a wrench.

At least some known fasteners include threads that are sized and oriented to engage with a complementary fastener. For at least some known fasteners, a tool, such as a wrench or pliers, may be used to apply torque to a fastener to engage the fastener with the complementary fastener. More specifically, at least some known tools include an open end or a socket that is sized to engage the fastener, and a drive tool, such as a ratchet or a power tool, that extends from the socket to enable torque to be applied to the fastener by the socket.

Some known wrenches require at least a minimal amount of friction to ratchet. Furthermore, at least some known wrenches require a large radius for ratchet movement and/or lubrication for their best operation. Moreover, at least some known wrenches are bulky and/or heavy, and thus may be incapable of being used in locations of limited operating space.

To accommodate limited operating spaces, some known wrenches are fabricated with a low profile. In some situations, fastener assemblies include a washer, a split washer, or a bushing. Because of space considerations, at least some fasteners are manually started on the complementary fastener before a tool is used to apply torque to the fastener. However, in some cases, it may be more difficult to access the fastener assembly with a user's hands than with a tool. In these situations, such fasteners may be difficult to assemble and may require a time-consuming and/or tedious task.

It is possible to improve fastener engagement performance. The subject matter described herein facilitates decreasing installation time and/or repair time.

BRIEF DESCRIPTION

In one aspect, a device is provided for use with a wrench including an opening. The device is coupleable to the wrench. The device includes a flange that extends outward from the device and remains spaced a distance from the wrench such that a slot is defined therebetween when the device is coupled to the wrench. The slot is sized and oriented to receive at least one of a washer and a bushing.

In another aspect, a device is provided for use with a ratchet wrench including a socket. The device includes an elongated member and a ratcheting member. The elongated member is coupleable to the ratchet wrench. The ratcheting member is coupled to the elongated member. The ratcheting member engages the ratchet wrench to selectively rotate the socket.

In yet another aspect, a coupling system is provided. The system includes a wrench and a device. The wrench includes an opening extending therethrough. The device is coupled to the wrench. The device includes a flange that extends outward from the device and remains spaced a distance from the wrench such that a slot is defined therebetween. The slot is sized and oriented to receive at least one of a washer and a bushing.

The features, functions, and advantages that have been discussed can be achieved independently in various embodiments of the present invention or may be combined in yet other embodiments further details of which can be seen with reference to the following description and drawings.

DETAILED DESCRIPTION

The subject matter described herein relates generally to hand tools. More specifically, the subject matter described herein relates to a tool for use in assembling a fastening assembly. In one embodiment, the device includes an elongated member and a ratcheting member that is coupled to the elongated member. The device is coupled to a ratchet wrench that includes a socket sized to receive a fastener therein. The ratcheting member engages the ratchet wrench to selectively rotate the socket.

As used herein, an element or step recited in the singular and proceeded with the word "a" or "an" should be understood as not excluding plural elements or steps unless such exclusion is explicitly recited. Furthermore, references to "one embodiment" of the present invention are not intended to be interpreted as excluding the existence of additional embodiments that also incorporate the recited features.

Figure 1:
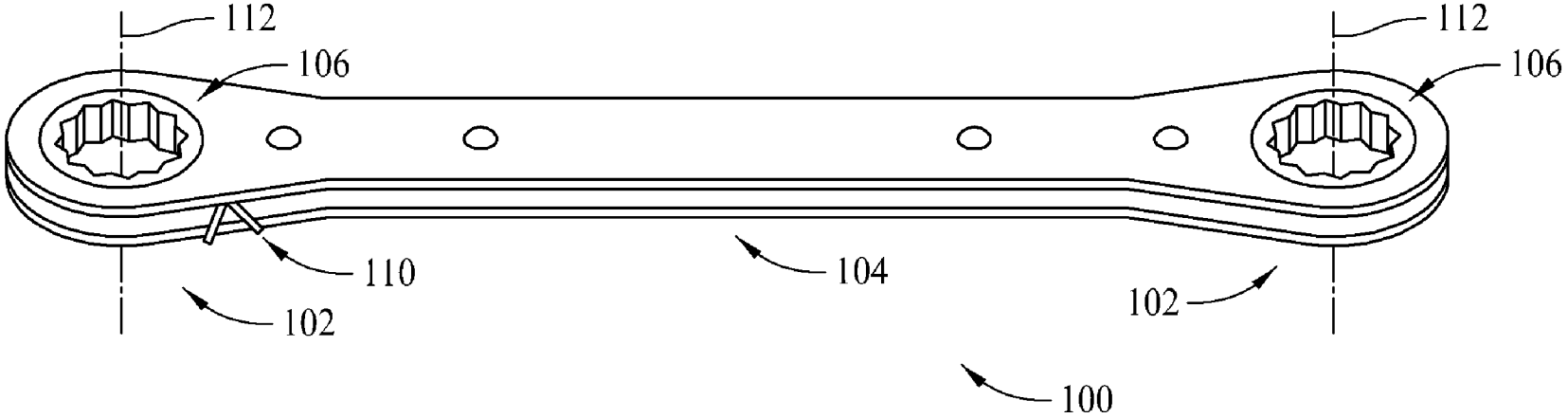
FIG. 1 illustrates a perspective view of an exemplary known ratchet wrench.

FIG. 1 illustrates an exemplary known ratchet wrench 100 that includes a pair of heads 102 and a wrench handle 104 that extends between heads 102. In one embodiment, handle 104 includes at least one bend such that heads 102 are positioned at different elevations. In the exemplary embodiment, each head 102 includes a socket 106 formed integrally therewith. Socket 106 enables tightening and/or loosening of a fastener assembly component (not shown) with a ratcheting motion such that the necessity of removing and/or repositioning ratchet wrench 100 after each rotational movement turn of the fastener assembly component is eliminated. Known fastener assemblies include, but are not limited to only including, a nut, a screw, a bolt, a threaded shaft, a bushing, and/or a washer. In one embodiment, a nut is threadably coupled to a threaded shaft such that a washer is between the nut and a base of the threaded shaft.

In the exemplary embodiment, socket 106 is rotatable in a clockwise direction and/or in a counterclockwise direction about an axis of rotation 112. In the exemplary embodiment, socket 106 is coupled to a lever 110 that is selectively actuatable and/or switchable to reverse a direction of the ratcheting motion, i.e., a direction of rotation necessary to tighten and/or to loosen a fastener assembly component.

Sockets 106 are sized to receive different fastener assembly components therein. Each socket 106 is sized to receive at least a portion of the fastener component therein. Typically, sockets 106 are produced in a six-point configuration or in a twelve-point configuration. Generally, twelve-point configurations are usable with square-shaped fasteners and provide more "starting points" than six-point configurations. However, twelve-point configurations have an increased likelihood of fastener assembly components rounding and/or slipping as compared to six-point configurations. As such, twelve-point configurations are generally faster and more versatile to use than six-point configurations, but six-point configurations generally provide greater torque values than twelve-point configurations. In some embodiments, eight-point configurations are also available.

Figure 2:
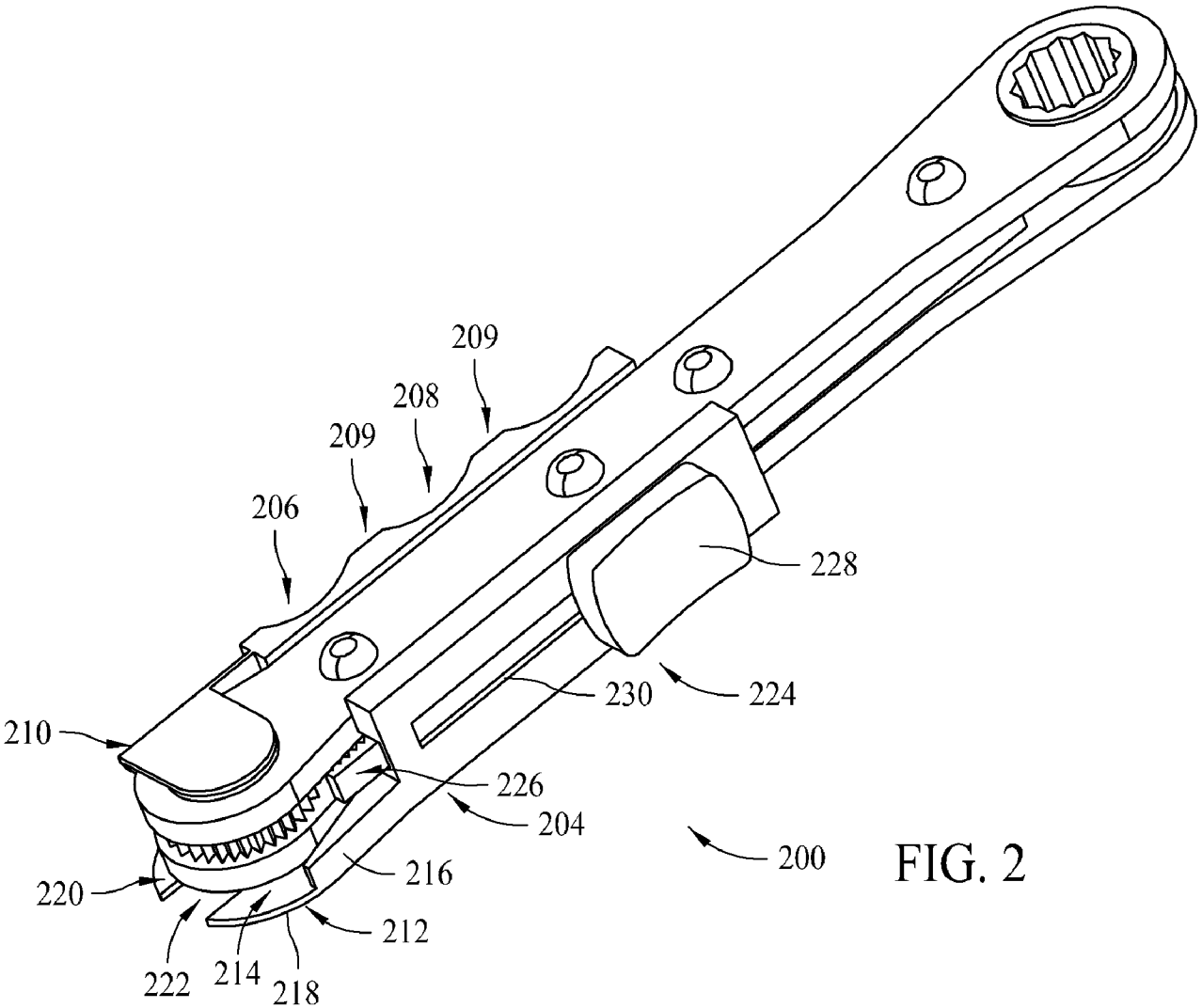
FIG. 2 is an exemplary device that may be used with the ratchet wrench shown in FIG. 1 to temporarily retain fastening hardware during assembly.

FIG. 2 illustrates a device 200 that may be used with ratchet wrench 100. More specifically, in the exemplary embodiment, device 200 retains at least a portion of a fastener assembly component (not shown), such as a nut, in place during assembly and, more specifically, while the nut is threadably coupled to a complementary fastener assembly component (not shown), such as a threaded shaft. Moreover, in the exemplary embodiment, device 200 also retains at least a portion of a washer, a split washer, or a bushing to be installed between the nut and the threaded shaft during assembly.

In the exemplary embodiment, device 200 includes an elongated member 204 that is removably coupled to wrench handle 104. As such, device 200 is selectively coupled to, or decoupled from, ratchet wrench 100. More specifically, in the exemplary embodiment, elongated member 204 is coupled against wrench handle 104 in a snap-fit connection. Alternatively, elongated member 204 may be integrally fabricated with wrench handle 104 and/or may be coupled to wrench handle 104 using any known fastening means that enables device 200 and ratchet wrench 100 to function as described herein.

In the exemplary embodiment, elongated member 204 includes a finger grip 206 that is ergonomically contoured. More specifically, in the exemplary embodiment, finger grip 206 is fabricated with a scalloped profile that includes at least one valley 208 that is sized and oriented to receive at least a portion of a user's finger (not shown) therein. Each valley 208 is defined between a pair of peaks 209.

In the exemplary embodiment, elongated member 204 includes a retaining portion 210 that is selectively positionable over at least a portion of socket 106. Specifically, in the exemplary embodiment, retaining portion 210 is selectively extendable over at least a portion of socket 106 to facilitate retaining the nut within socket 106 during assembly.

In the exemplary embodiment, elongated member 204 also includes a flange 212 that is selectively positionable relative to socket 106. More specifically, in the exemplary embodiment, flange 212 extends outward from elongated member 204 on a side of socket 106 that is opposite retaining portion 210. When flange 212 is extended past socket 106, a slot 214 is defined between flange 212 and socket 106. Slot 214 is sized to receive a washer therein. For example, in one embodiment, slot 214 retains a 0.500 O.D.×0.05" washer therein, while retaining portion 210 retains a 5/16" nut in socket 106.

Moreover, flange 212 is oriented such that when the washer is received within slot 214, the washer is aligned substantially concentrically with a nut or bolt head retained in socket 106. To facilitate aligning the washer relative to socket 106, in the exemplary embodiment, flange 212 includes a side wall 216 and a base wall 218 that extends substantially perpendicularly from side wall 216. More specifically, in the exemplary embodiment, side wall 216 is oriented substantially parallel to axis of rotation 112, and base wall 218 is oriented substantially perpendicular to axis of rotation 112.

In the exemplary embodiment, elongated member 204 also includes a second flange 220 that is spaced a distance from flange 212 such that a gap 222 is defined therebetween. More specifically, in the exemplary embodiment, flanges 212 and 220 are positioned in a mirrored arrangement on opposite sides of axis of rotation 112. Gap 222 is sized and oriented to receive a portion of the threaded shaft. For example, in one embodiment, gap 222 is sized to accommodate a 0.3125" diameter bolt shaft.

In the exemplary embodiment, a ratcheting member 224 is coupled to elongated member 204. In the exemplary embodiment, ratcheting member 224 is coupled to an opposite side of elongated member 204 than finger grip 206 such that, during use, ratcheting member 204 is oriented to receive at least a portion of the user's thumb while finger grip 206 receives at least a portion of the user's fingers.

In the exemplary embodiment, ratcheting member 224 engages ratchet wrench 100 to selectively rotate socket 106. More specifically, in the exemplary embodiment, ratcheting member 224 includes a plurality of teeth 226 that engage ratchet wrench 100 to selectively rotate socket 106 about axis of rotation 112.

In the exemplary embodiment, ratcheting member 224 includes a thumb grip 228 that is slidably coupled within a slot 230 defined along a longitudinal axis of ratcheting member 224. In the exemplary embodiment, thumb grip 228 is used to drive ratchet wrench 100 to selectively rotate socket 106 without rotating ratchet wrench 100, device 200, and/or elongated member 204.

In one embodiment, ratcheting member 224 may engage ratchet wrench 100 to selectively actuate lever 110 to reverse a direction of rotation of socket 106. Thus, in such an embodiment, ratcheting member 224 may facilitate at least partially engaging and/or at least partially disengaging the nut with the threaded shaft.

During operation, in the exemplary embodiment, a desired ratchet wrench 100 is selected for use based on a size of the fastening assembly component. More specifically, in the exemplary embodiment, elongated member 204 is coupled against wrench handle 104 such that ratcheting member 224 is positioned to engage ratchet wrench 100 to selectively rotate socket 106. In the exemplary embodiment, device 200 is coupled to ratchet wrench 100 to facilitate retaining the nut in socket 106 and/or the washer within slot 230 during assembly.

In the exemplary embodiment, during assembly, a washer is inserted within slot 214, and a nut is inserted within socket 106. Additionally, in the exemplary embodiment, retaining portion 210 is selectively extended over at least a portion of socket 106 to facilitate retaining the nut within socket 106 during assembly. More specifically, in the exemplary embodiment, the washer is aligned substantially concentrically with the nut and/or socket 106. Alternatively, the washer is inserted within slot 214 and a bolt head may be inserted within socket 106 and extended through the washer for coupling to a threaded opening.

In the exemplary embodiment, ratcheting member 224 selectively rotates socket 106. More specifically, in the exemplary embodiment, as thumb grip 228 is moved along slot 230, socket 106 is rotated about axis of rotation 112 to enable the nut to at least partially engage the threaded shaft.

In the exemplary embodiment, after the nut is at least partially engaged with the threaded shaft, device 200 is removed from ratchet wrench 100. More specifically, in the exemplary embodiment, when the nut is at least partially engaged with the threaded shaft, the washer is aligned substantially concentrically to the nut and the threaded shaft extends through the washer. Ratchet wrench 100 may then subsequently tighten the nut onto the threaded shaft using an appropriate amount of torque.

Figure 3:
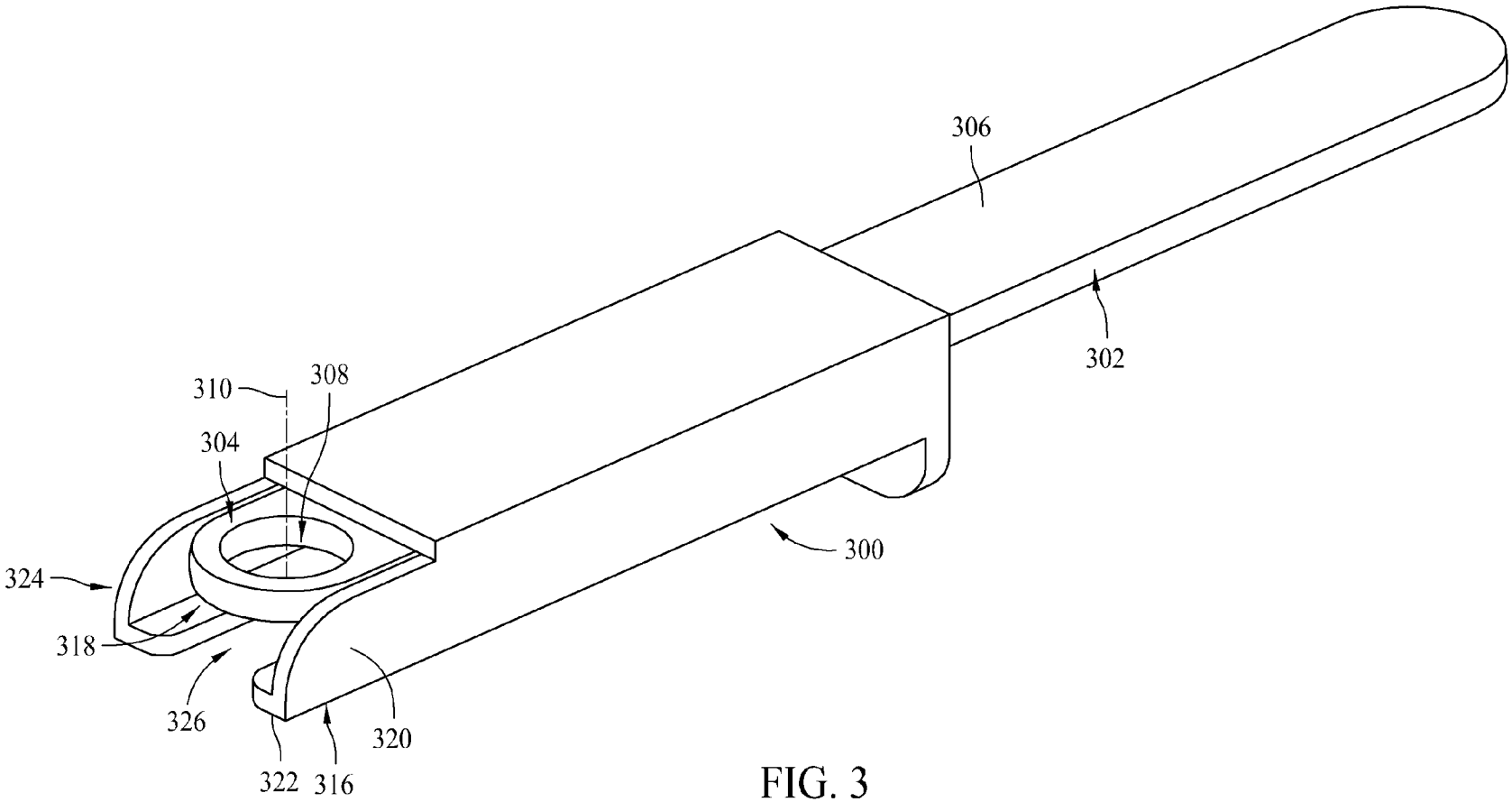
FIG. 3 is an alternative device for temporarily retaining fastening hardware during assembly.

FIG. 3 illustrates an alternative device 300 for use in retaining fastening hardware during assembly. In the exemplary embodiment, device 300 is removably coupled to a wrench 302. As such, device 300 is selectively coupled to, or decoupled from, wrench 302. In the exemplary embodiment, wrench 320 includes a head 304 and a wrench handle 306 that extends from head 304. In the exemplary embodiment, head 304 includes an opening 308 defined therethrough. Opening 308 is sized to receive at least a portion of a fastener assembly component (not shown), such as a nut, a screw, a bolt, and/or a threaded shaft, therein. Wrench 302 is configured to rotate the fastener assembly component about an axis of rotation 310.

In the exemplary embodiment, device 300 retains at least a portion of a washer, a split washer, or a bushing between the fastener assembly component and a complementary fastener assembly component (not shown) during assembly. Moreover, device 300 may include a finger grip and/or a retaining portion as are described above with respect to elongated member 204.

In the exemplary embodiment, device 300 includes a flange 316 that is selectively positionable relative to opening 308. When flange 316 is extended past opening 308, a slot 318 is defined between flange 316 and opening 308. Slot 318 is sized to receive a washer therein.

Moreover, flange 316 is oriented such that when the washer is received within slot 318, the washer is aligned substantially concentrically with the fastener assembly component retained in opening 308. To facilitate aligning the washer relative to opening 308, in the exemplary embodiment, flange 316 includes a side wall 320 and a base wall 322 that extends substantially perpendicularly from side wall 320. More specifically, in the exemplary embodiment, side wall 320 is substantially parallel to axis of rotation 310, and base wall 322 is substantially perpendicular to axis of rotation 310.

In the exemplary embodiment, device 300 also includes a second flange 324 that is spaced a distance from flange 316 such that a gap 326 is defined therebetween. More specifically, in the exemplary embodiment, flanges 316 and 324 are positioned in a mirrored arrangement on opposites sides of axis of rotation 310. Gap 326 is sized and oriented to receive a portion of the fastener assembly component therein when the fastener assembly component is being coupled to the complementary fastener assembly component.

During operation, in the exemplary embodiment, a desired wrench 302 is selected for use based on a size of the fastening assembly component. In the exemplary embodiment, wrench 302 facilitates retaining the fastening assembly component within opening 308 and device 300 facilitates retaining the washer within slot 318 during assembly.

In the exemplary embodiment, during assembly a washer is inserted within slot 318, and a nut is inserted within opening 308. In the exemplary embodiment, the washer is aligned substantially concentrically with the fastener assembly component and/or opening 308.

In the exemplary embodiment, wrench 302 and/or device 300 is rotated about axis of rotation 310 to enable the fastener assembly component to at least partially engage the complementary fastener assembly component. Additionally, device 300 may be rotated about axis of rotation 310 to enable the fastener assembly component to at least partially disengage from the complementary fastener assembly component.

In the exemplary embodiment, after the fastener assembly component is at least partially engaged with the complementary fastener assembly component, device 300 is removed from wrench 302. More specifically, in the exemplary embodiment, when the fastener assembly component is at least partially engaged with the complementary fastener assembly component, the washer is aligned substantially concentrically to the fastener assembly component and the threaded shaft extends through the washer. Wrench 302 may then subsequently tighten the nut onto the threaded shaft using an appropriate amount of torque.

Exemplary embodiments of fastening methods, devices, and systems are described and/or illustrated herein in detail. The exemplary methods and systems facilitate accessing fastener assemblies in locations of limited operating space. As such, the methods and systems described herein facilitate decreasing installation time and/or repair time. The exemplary systems and methods are not limited to the specific embodiments described herein, but rather, components of each system and/or steps of each method may be utilized independently and separately from other components and/or method steps described herein. Each component and each method step may also be used in combination with other components and/or method steps.

This written description uses examples to disclose certain embodiments of the present invention, including the best mode, and also to enable any person skilled in the art to practice those certain embodiments, including making and using any devices or systems and performing any incorporated methods. The patentable scope of the present invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A device for use with a wrench including an opening, said device coupleable to the wrench and comprising:

a first flange that extends outward from said device and remains spaced a distance from the wrench such that a slot is defined therebetween when the device is coupled to the wrench, said slot sized and oriented to receive at least one of a washer and a bushing; and a second flange that extends outward from said device such that a gap is defined between said first flange and said second flange, said gap sized to receive a portion of a threaded shaft.

2. A device in accordance with claim 1, wherein said first flange is oriented such that at least one of the washer and the bushing received within said slot is aligned substantially concentrically with the opening.

3. A device in accordance with claim 1, wherein said first flange comprises at least a side wall and a base wall that is substantially perpendicular to said side wall.

4. A device in accordance with claim 1 further comprising a finger grip that is fabricated with a scalloped profile.

5. A device for use with a ratchet wrench including a socket, said device comprising:

an elongated member that is coupleable to the ratchet wrench, wherein said elongated member comprises a retaining portion that is selectively positionable over at least a portion of the socket; and a ratcheting member coupled to said elongated member, said ratcheting member engages the ratchet wrench to selectively rotate the socket.

6. A device in accordance with claim 5, wherein said elongated member comprises at least a first flange that extends outward from said elongated member and remains spaced a distance from the ratchet wrench such that a slot is defined therebetween when said elongated member is coupled to the ratchet wrench, said slot sized and oriented to receive at least one of a washer and a bushing.

7. A device in accordance with claim 6, wherein said first flange is oriented such that at least one of the washer and the bushing received within said slot is aligned substantially concentrically with the socket.

8. A device in accordance with claim 6, wherein said elongated member further comprises a second flange that extends outward from said elongated member such that a gap is defined between said first flange and said second flange, said gap sized and oriented to receive a portion of a threaded shaft.

9. A device in accordance with claim 5, wherein said elongated member comprises at least a first flange comprising at least a side wall and a base wall that is substantially perpendicular to said side wall.

10. A device in accordance with claim 5, wherein said elongated member comprises a finger grip that is fabricated with a scalloped profile.

11. A device in accordance with claim 10, wherein said finger grip is positioned opposite said ratcheting member.

12. A device in accordance with claim 5, wherein said ratcheting member comprises a plurality of teeth that engage the ratchet wrench to selectively rotate the socket.

13. A device in accordance with claim 5, wherein the ratchet wrench includes a lever that is selectively actuatable to reverse a direction of rotation of the socket, and wherein said ratcheting member engages the ratchet wrench to selectively reverse the direction of rotation of the socket.

14. A device in accordance with claim 5, wherein said ratcheting member selectively rotates the socket without rotating said elongated member.

15. A coupling system comprising:

a wrench comprising an opening extending therethrough; and a device coupled to said wrench, said device comprising at least a first flange and a second flange, wherein said first flange extends outward from the device and remains spaced a distance from said wrench such that a slot is defined therebetween, said slot is sized and oriented to receive at least one of a washer and a bushing, said second flange extends outward from said device such that a gap is defined between said first flange and said second flange, and said gap is sized to receive a portion of a threaded shaft.

16. A system in accordance with claim 15, wherein said device comprises a retaining portion that is selectively positionable over at least a portion of said opening.

17. A system in accordance with claim 15, wherein said opening includes a socket, and wherein said device comprises a ratcheting member that engages said socket to selectively rotate said socket.

18. A device for use with a ratchet wrench including a socket, said device comprising:

an elongated member that is coupleable to the ratchet wrench, wherein said elongated member comprises at least a first flange that extends outward from said elongated member and remains spaced a distance from the ratchet wrench such that a slot is defined therebetween when said elongated member is coupled to the ratchet wrench, said slot sized and oriented to receive at least one of a washer and a bushing; and a ratcheting member coupled to said elongated member, said ratcheting member engages the ratchet wrench to selectively rotate the socket.

19. A device for use with a ratchet wrench including a socket, said device comprising:

an elongated member that is coupleable to the ratchet wrench; and a ratcheting member coupled to said elongated member, said ratcheting member engages the ratchet wrench to selectively rotate the socket, wherein the ratchet wrench includes a lever that is selectively actuatable to reverse a direction of rotation of the socket, and wherein said ratcheting member engages the ratchet wrench to selectively reverse the direction of rotation of the socket.

20. A coupling system comprising:

a wrench comprising an opening extending therethrough, wherein the opening includes a socket; and a device coupled to said wrench, said device comprising at least a first flange and a ratcheting member, wherein said first flange extends outward from the device and remains spaced a distance from said wrench such that a slot is defined therebetween, said slot is sized and oriented to receive at least one of a washer and a bushing, and said ratcheting member engages said socket to selectively rotate said socket.

* * * * *